United States Patent [19]

Tornoe et al.

[11] Patent Number: 4,781,640

[45] Date of Patent: Nov. 1, 1988

[54] BASKET ELECTRODE SHAPING

[75] Inventors: Robert N. Tornoe, Fremont; Semler D. Jackson, Sunnyvale, both of Calif.

[73] Assignee: Varian Associates, Inc., Palo Alto, Calif.

[21] Appl. No.: 876,657

[22] Filed: Jun. 18, 1986

Related U.S. Application Data

[63] Continuation of Ser. No. 694,539, Jan. 24, 1985, abandoned.

[51] Int. Cl.[4] ..... H01J 9/02

[52] U.S. Cl. ..... 445/50; 445/35; 445/49

[58] Field of Search ..... 445/35, 36, 49, 50; 313/341, 337, 343, 346 R

[56] References Cited

U.S. PATENT DOCUMENTS

| | | | |
|---|---|---|---|
| 1,870,968 | 8/1932 | Sinden | 445/35 |
| 2,269,081 | 1/1942 | Felsner | 445/50 |
| 2,723,926 | 11/1955 | Bellott | 445/50 |
| 2,882,436 | 4/1959 | Porgelo | 313/346 |
| 3,045,320 | 7/1962 | Apelbaum | 445/50 |
| 3,172,002 | 3/1965 | Johnson | 313/346 |
| 3,201,849 | 8/1965 | Voss | 445/49 |
| 3,216,085 | 11/1965 | Thon | 445/35 |
| 3,249,791 | 5/1966 | Kendall | 313/346 |
| 3,544,832 | 12/1970 | Brous | 445/35 |
| 3,567,989 | 3/1971 | Koshizuka | 313/346 |
| 3,758,808 | 9/1973 | Held | 313/346 |
| 3,800,378 | 4/1974 | Lee | 445/35 |
| 3,823,453 | 7/1974 | Van Stratum | 445/35 |
| 4,144,473 | 3/1979 | Almer | 313/349 |
| 4,277,713 | 7/1981 | Hasker | 445/35 |
| 4,443,735 | 4/1984 | Alexandrov | 313/341 |

*Primary Examiner*—Kurt Rowan

*Attorney, Agent, or Firm*—Stanley Z. Cole; Gerald M. Fisher; Peter J. Sgarbossa

[57] ABSTRACT

The invention is a method of manufacture of a cylndrical electrode such as a thermionic cathode comprising an array of helical filaments. The method comprises the step of placing the array, attached to its support electrodes which are fixedly mounted to a common subassembly support, inside a close-fitting refractory dielectric cylinder and heating the filament assembly by passing current through the filaments. The filament assembly expands to contact the form. On further heating it is plastically deformed to form a perfect cylindrical shape. After cooling and shrinking, it is removed from the form.

13 Claims, 1 Drawing Sheet

BASKET ELECTRODE SHAPING

This application is a continuation of application Ser. No. 694,539, filed Jan. 24, 1985, now abandoned.

FIELD OF THE INVENTION

The invention pertains to basket structures formed of wires, such as used as thermionic cathodes for grid-controlled, high powered electron tubes.

PRIOR ART

Many grid-controlled electron tubes have used thermionic cathodes formed by a cylindrical array of helical filaments, generally of thoriated tungsten. One set of said filaments had a certain helical pitch and the other set an opposite helical pitch. The cylindrical array is formed by spacing the filaments around a cylindrical metallic mandrel which may be a spot-welding electrode. At the spots where filaments of opposite pitch cross, they typically are spot-welded together. In the prior art the filaments are joined together to form a basket-like cylindrical cage which was set into its cyindrical shape by firing at a high temperature with a cylindrical form inside the cage. Each end of each filament is then welded to a cylindrical metallic ring which serves as a commond current-connecting element for all the filaments in parallel.

A major problem with the prior art procedure was that after the initial shaping, the step of spot welding the filaments to their support electrodes introduced strains in the metals. After assembly of the complete electrode structure, the filaments were carburized by heating a high temperature in an atmosphere of carbon-containing gas such as a volatile hydrocarbon. During the carburization these strains were relieved by deformation of the parts. At this point it was not practical to reshape the parts to their desired true cylindrical outline because the carburized tungsten is very brittle.

BRIEF DISCUSSION OF THE FIGURES

SUMMARY OF THE INVENTION

The object of the invention is to produce a cylindrical basket electrode structure having closely controlled, stable dimensions. This object is achieved by adding a novel shaping step which comprises placing around the assembled electrode structure a cylinder of ceramic having a hollow bore which fits around the filaments. The assembly is then placed in a vacuum and the filaments are heated by passing current between their end support electrodes. The filament structure expands until it comes in contact with the ceramic tube and on further heating is constrained to remain and become annealed in this accurate cylindrical outline.

DESCRIPTION OF THE PREFERRED EMBODIMENTS

The method of making the inventive electrode structure comprises a series of steps.

A plurality of wires as of thoriated tungsten are spaced around a cylindrical mandrel, which may be a spot-welding electrode. The wires, which may be pieces of a single long continuous wire, are wound helically about the mandrel. One set has a first helical pitch and a second set has the opposite helical pitch. Typically the second set is outside the first set. Where wires of opposite pitch cross, they are spot-welded together to form a unitary basket structure. This basket structure may receive a first shape-setting step by being placed around a refractory cylindrical jig with a second hollow cylindrical jig outside structure. The basket, constrained by the jig, is then fired, as in a hydrogen atmosphere or vacuum, at a high temperature to anneal the wires to be strain-free in their constrained shape.

Figure 1:
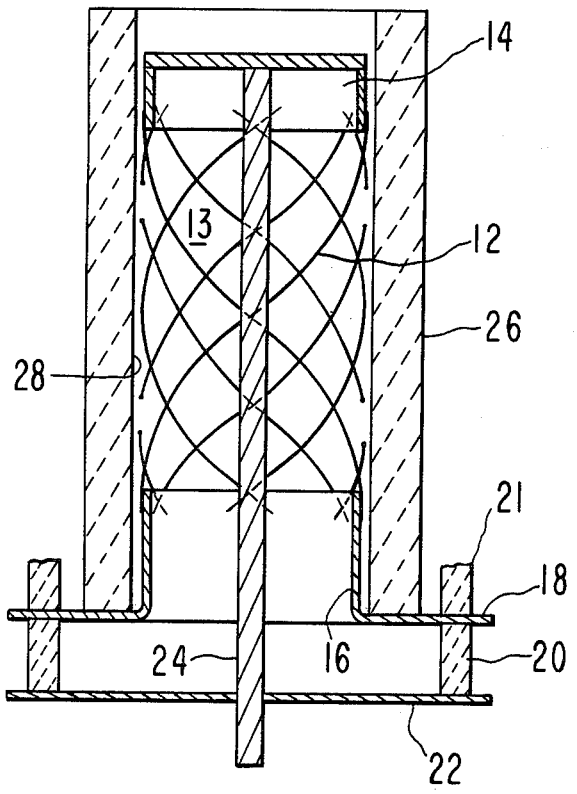
FIG. 1 is a schematic section through the axis of a thermionic cathode structure embodying the invention, preparatory to the inventive step of its formation.

In the next step the basket array is mounted on a pair of support electrodes as shown in FIG. 1. The basket 13 of filaments 12 is mounted with the ends of its filaments projecting over the cylindrical ends of an upper support electrode 14 and a lower support electrode 16. The ends of filaments 12 are then spotwelded to the support electrodes. Lower support electrode 16 has a flat flange 18 which is brazed between ceramic insulating rings 20 and 21 which are part of the vacuum envelop of the tube. Upper support electrode 14 is mounted on an axial metallic rod 24, as of molybdenum, which in turn is brazed to ceramic ring 20 via a flat ring portion 22. The assembly of the support electrodes 14, 16 with their support structure 18, 20, 21, 22, 24 is of course completed before the array of filaments 12 is attached to it.

As described above, the process of affixing the basket array to the support electrodes 14, 16 may produce strains in the parts. On subsequent heating, such as in carburizing thoriated tungsten filaments or in actual operation as a thermionic cathode, these strains can cause mechanical distortions which spoil the cylindrical shape.

Figure 2:
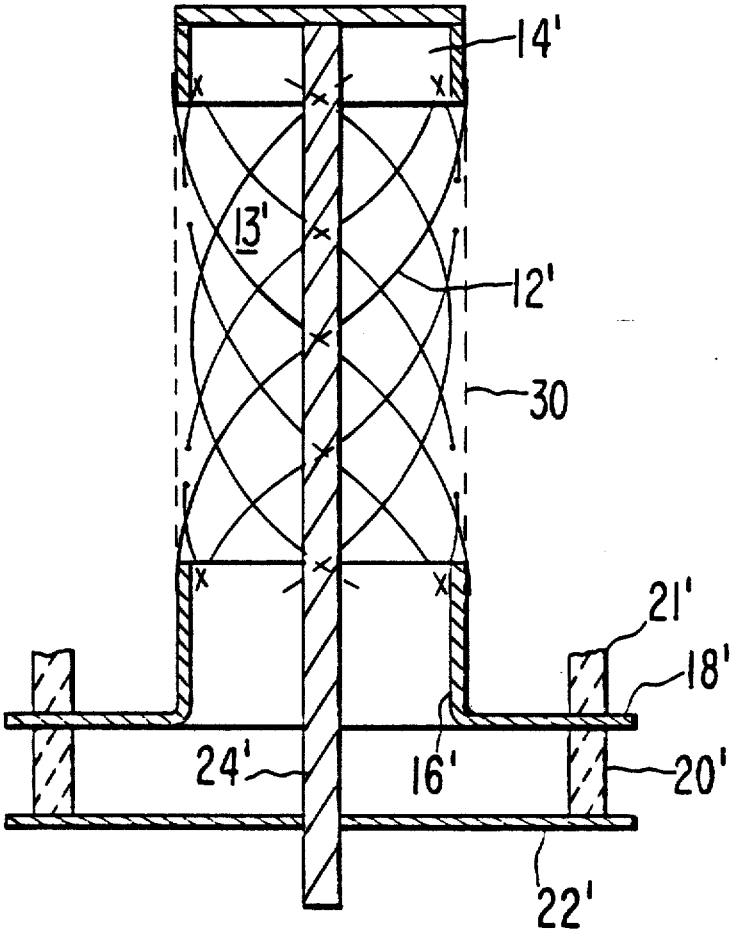
FIG. 2 is a schematic section through the axis of the cold shape of the cathode of FIG. 1 after the inventive forming process.

In practicing the invention, after mounting the basket filaments 12 to support electrodes 14 and 16, a refractory dielectric form 26 is placed outside the basket array. Form 26 is typically a high-alumina ceramic. It may be of any desired external shape, but it has a hollow cylindrical bore 28 with a diameter which fits closely over the outer surfaces of basket structure 13. The assembly with form 26 in place is placed in an inert atmosphere, preferably a vacuum. Filaments 12 are then heated by passing current between support electrodes 14, 16 via external leads 18 and 24. During this heating, basket structure 13 expands until its outer wires 12 touch form 26. Form 26 remains relatively cool and has a low thermal expansivity so it does not expand very much. On further heating, basket structure 13 is constrained from further expansion, so the wires 12 are plastically deformed to form a perfect fit in the cylindrical form recess 28. As the assembly is cooled, basket 13 shrinks away from form 26, leaving it with a slight hour-glass shape. FIG. 2 illustrates the hour-glass shape of the cathode when cooled to room temperature as contrasted to the cylindrical hot envelope 30. This shape is advantageous because on subsequent heating during operation it can again expand into a perfect cylindrical outline as indicated by the dashed envelope cylinder 30.

After the shaping operation, form 26 is removed and filaments 12, if made of thoriated tungsten, are carburized on their surfaces by heating basket structure 13 in a reducing or inert atmosphere containing carbonaceous material such as a volatile hydrocarbon which decomposes at the filament temperature, producing carbon which forms a carbide layer on the filament surfaces. The electrode strucure is then ready for assembly into an electronic vacuum tube such as a grid-controlled triode or tetrode.

The above example is intended to be illustrative of a preferred embodiment of the invention. Other embodiments may become obvious to those skilled in the art. For example, the precisely shaped basket cylinder may be used as a grid in tubes of cylindrical geometry. The invention is intended to be limited only by the following claims and their legal equivalence.

What is claimed is:

1. A method of shaping an electrode structure comprising: a plurality of helical wire filaments, said method comprising:

forming a cylindrical array of helical filaments, each filament being bonded at a first end to a first common metallic cylinder and at a second end to a second common metallic cylinder, said metallic cylinders being mechanically fixed to a common support means and mutually insulated, the invention wherein comprising the additional steps of placing around said cylindrical array a form of temperature resistant dielectric material having a cylindrical opening sized to contain said array, placing said array and form in an inert environment, heating said filaments in said inert environment by passing electric current between said metallic cylinders, so that at least some of said filaments expand to be restrained by the surface of said opening, and cooling said electrode structure, such that said filament array contracts away from said form, and removing said form.

2. The method of claim 1 wherein said cylindrical array comprises filaments of opposite pitch and said forming of said cylindrical array comprises bonding said filaments together at their crossovers.

3. The method of claim 1 wherein said inert environment is a vacuum.

4. The method of claim 1 wherein said filaments are tungsten wires.

5. The method of claim 4 wherein said tungsten is thoriated.

6. The method of claim 1 further including the subsequent step of heating said filaments in said array in a carbonaceous atmosphere to carburize their surfaces.

7. The method of claim 6 wherein said carburization follows said removal from said form.

8. The process of claim 1 wherein during said heating said form remains much cooler than said filaments.

9. The process of claim 1 wherein the temperature of said heating is such that after completing said process and subsequently heating said filaments to their operating temperature, said array returns to a cylindrical shape.

10. A method of shaping an electrode structure comprising a plurality of helical wire filaments, said method comprising:

forming a cylindrical array of helical filaments, each filament being bonded at a first end to a first common metallic cylinder and at a second end to a second common metallic cylinder, said metallic cylinders being mechanically fixed to a common support means and mutually insulated, the invention wherein comprising the additional steps of placing around said cylindrical array a form of temperature resistant dielectric material having a cylindrical opening sized to contain said array, placing said array and form in an inert environment, heating said filaments in said inert environment to a temperature approximating their intended operating temperature by passing electric current between said metallic cylinders, so that at least some of said filaments expand to be constrained by the surface of said opening, and cooling said electrode structure, such that said filament array contracts away from said form, and removing said form.

11. The process of claim 10 wherein the dimensions of said form and the temperature of said heating are such that after completing said process and subsequently heating said filaments to their intended operating temperature said array returns to a cylindrical shape.

12. The process of claim 10 wherein during said heating said form remains much cooler than said filaments.

13. An electrode structure for an electron tube, said structure comprising:

a generally cylindrical array of helical filaments, each filament being bonded at a first common metallic cylinder and at a second end to a second common metallic cylinder, said cylinders being coaxial and mechanically and electrically joined to a common support structure and mutually insulated, the outline of said array at room temperature being generally axially symmetric about the axis of said cylinders, and having a diameter perpendicular to said axis smaller at a section axially between said cylinders than its diameter at said cylinders such that when said array is heated to its intended operating temperature, said outline becomes essentially cylindrical.

* * * * *

UNITED STATES PATENT AND TRADEMARK OFFICE

CERTIFICATE OF CORRECTION

PATENT NO. : 4,781,640

DATED : November 1, 1988

INVENTOR(S) : Robert N. Tornoe

It is certified that error appears in the above-identified patent and that said Letters Patent is hereby corrected as shown below:

The sheet of drawing consisting of Figure 2 should be added as per attached sheet.

On the title page, "13 Claims, 1 Drawing Sheet" should read

-- 13 Claims 2 Drawing Sheets --.

Signed and Sealed this

Fourteenth Day of March, 1989

*Attest:*

*Attesting Officer*

DONALD J. QUIGG

*Commissioner of Patents and Trademarks*

Patent No. 4,781,640

November 1, 1988

Robert N. Tornoe